US010650961B2

(12) United States Patent
Chuang

(10) Patent No.: US 10,650,961 B2
(45) **Date of Patent: *May 12, 2020**

(54) APPARATUS OF COUPLED INDUCTORS WITH BALANCED ELECTROMOTIVE FORCES

(71) Applicant: CYNTEC CO., LTD., Hsinchu (TW)

(72) Inventor: Chia-Cheng Chuang, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/246,569

(22) Filed: Jan. 14, 2019

(65) Prior Publication Data

US 2019/0148062 A1 May 16, 2019

Related U.S. Application Data

(62) Division of application No. 15/279,379, filed on Sep. 28, 2016, now Pat. No. 10,210,992.

(60) Provisional application No. 62/238,098, filed on Oct. 6, 2015.

(51) Int. Cl.

| | |
|---|---|
| ***H01F 17/04*** | (2006.01) |
| ***H01F 27/40*** | (2006.01) |
| ***H01F 3/10*** | (2006.01) |
| ***H01F 27/28*** | (2006.01) |
| ***H01F 27/29*** | (2006.01) |

(52) U.S. Cl.

CPC ..... *H01F 27/40* (2013.01); *H01F 3/10* (2013.01); *H01F 17/045* (2013.01); *H01F 27/2823* (2013.01); *H01F 27/29* (2013.01)

(58) Field of Classification Search

CPC ..... H01F 27/40; H01F 27/29; H01F 28/23; H01F 27/2823

USPC ..... 336/83, 192, 200, 232

See application file for complete search history.

(56) References Cited

U.S. PATENT DOCUMENTS

2004/0145439 A1* 7/2004 Grilo ..... H01F 19/08 336/145

2010/0019752 A1* 1/2010 Diab ..... H04L 12/10 323/305

(Continued)

FOREIGN PATENT DOCUMENTS

CN 102227788 A 10/2011

CN 102308347 A 1/2012

(Continued)

*Primary Examiner* — Tszfung J Chan

(74) *Attorney, Agent, or Firm* — Winston Hsu

(57) ABSTRACT

An apparatus of coupled inductors includes a first coil and a second coil arranged in a way that an inter-coil capacitance between the first coil and the second coil can keep electromotive forces induced by a first inductance of the first coil and a second inductance of the second coil about the same. As the current bypasses an unbalanced parasitic capacitor, a compensation capacitor disposed between the two coils can compensate the inter-coil capacitance of the parasitic capacitor. The apparatus of coupled inductors implemented with a specific coil arrangement or disposed with the compensation capacitor can keep the EMFs induced over the two inductances equal in amplitude, which prevents both the differential-mode and common-mode interference from being converted, improving the characteristics of mode conversion and is suitable to be utilized in a PoE system or the like.

15 Claims, 13 Drawing Sheets

(56) References Cited

U.S. PATENT DOCUMENTS

| | | | | |
|---|---|---|---|---|
| 2010/0109827 | A1* | 5/2010 | Asou | H01F 17/045 336/192 |
| 2011/0203105 | A1 | 8/2011 | Ishido | |
| 2011/0248813 | A1 | 10/2011 | Noda | |
| 2014/0002227 | A1 | 1/2014 | Hsieh | |
| 2014/0097928 | A1 | 4/2014 | Tomonari | |
| 2014/0167903 | A1* | 6/2014 | Tomonari | H01F 17/045 336/220 |
| 2015/0162126 | A1* | 6/2015 | Kanbe | H01F 27/2823 336/192 |
| 2016/0155561 | A1* | 6/2016 | Takagi | H01F 27/2823 336/222 |
| 2017/0025212 | A1 | 1/2017 | Jerez | |

FOREIGN PATENT DOCUMENTS

| | | | | |
|---|---|---|---|---|
| CN | 203746604 | U | | 7/2014 |
| DE | 10 2014 103 324 | A1 | | 9/2015 |
| JP | 2006261572 | A | * | 9/2006 |
| JP | 2012256669 | A | * | 12/2012 |
| TW | 201440095 | A | | 10/2014 |

* cited by examiner

APPARATUS OF COUPLED INDUCTORS WITH BALANCED ELECTROMOTIVE FORCES

CROSS REFERENCE TO RELATED APPLICATIONS

This application is a division of U.S. non-provisional application Ser. No. 15/279,379 filed on 2016 Sep. 28, which claims the benefit of U.S. provisional application No. 62/238,098 filed on 2015 Oct. 6.

BACKGROUND OF THE INVENTION

1. Field of the Invention

The present invention is related to an apparatus of coupled inductors, more particularly, to an apparatus of coupled inductors capable of improving differential to common-mode conversion.

2. Description of the Related Art

Power over Ethernet (PoE) provides a framework for delivery of power from power sourcing equipment (PSE) to a powered device (PD) over Ethernet cabling. Various types of PDs exist, including voice over IP (VoIP) phones, wireless local area network (LAN) access points, Bluetooth access points, network cameras, computing devices, etc. In one type of PoE system called PoDL, direct-current (DC) power is transmitted over a single data-carrying wire pair. The same data-carrying wire pair may also transmit/receive differential alternating-current (AC) data signals. In this way, the need for providing any external power source for the PDs can be eliminated. The standards for PoE and PoDL are set out in IEEE 802.3 and are well-known to those skilled in the art.

Apparatuses of coupled inductors adopted in PoE systems normally provide sufficiently high impedance across the wire pair to support transmission of differential-mode data signals. One major function of such apparatuses is to prevent a differential-mode data signal from being converted into a common-mode interference. The common-mode interference may alter the DC voltage level at the powering or powered nodes, which makes the power delivery system unstable. Furthermore, the common-mode interference may also be present at the wire pair so that it may flow throughout the wire pair and consequently not only produces errors during data processing of the system but also becomes a source of EMI (electromagnetic interference) as it radiates from the wire pair. The differential-mode data signal is normally driven by two AC current portions of equal magnitude and opposite directions and are separately carried over the wire pair. As the two AC current portions individually flow through the two coupled inductors of the apparatus, they induce two electromotive forces (EMFs) of equal amplitude and opposite directions, each over the corresponding inductor, as the two inductors perform and couple without any parasitic effect. Then the two EMFs produce no common-mode interference through a common-mode operation, which sums up the two EMFs and thus comes out a zero potential sum. However, such apparatuses composed of real inductors can result in a non-zero potential sum since an inter-coil capacitance inevitably exists by the real inductors. The inter-coil capacitance is regarded as a parasitic element and can compromise the above described mechanism of producing the zero potential sum, thus producing the non-zero potential sum instead that causes the common-mode interference. The common-mode interference is equivalently regarded as being converted from the differential-mode data signal by the above described non-ideal characteristic of the apparatus of coupled inductors. In this field of application, the above described non-ideal characteristic of the apparatus of coupled inductors is specifically termed differential to common-mode conversion.

Apparatuses of coupled inductors adopted in PoE systems is also expected to provide another major function, which is to prevent a common-mode noise from being converted into a differential-mode interference. Similar to the aforementioned consequence of the common-mode interference, the differential-mode interference also may make the power delivery system unstable, produce errors during data processing of the system, and become a source of EMI. The common-mode noise is normally driven in the form of common-mode AC current that comprises two AC current portions of equal amplitude and a same direction. When the noise impinges the coupled inductors of the apparatus, the two AC current portions induce two EMFs of equal amplitude and a same direction, each over the corresponding inductor, as the two inductors perform and couple without any parasitic effect. Then the two EMFs produce no differential-mode interference through a differential-mode operation, which subtracts one of the two EMFs by the other and thus comes out a zero potential difference. However, such apparatuses composed of real inductors can result in a non-zero potential difference since an inter-coil capacitance inevitably exists by the real inductors. The inter-coil capacitance can compromise the above described mechanism of producing the zero potential difference, thereby producing the non-zero potential difference instead that drives the differential-mode interference. The differential-mode interference is equivalently regarded as being converted from the common-mode noise by the above described non-ideal characteristic of the apparatus of coupled inductors. In this field of application, the above described non-ideal characteristic of the apparatus of coupled inductors is specifically termed common to differential-mode conversion.

SUMMARY OF THE INVENTION

The inevitable inter-coil capacitance generally exists as a result of the physical spacing between the coils forming the inductors and the presence of a dielectric medium around the coils. Both common and differential-mode interference can arise since the inter-coil capacitance results in the two non-ideal characteristics, differential to common-mode and common to differential-mode conversions. In general, both characteristics are lumped to one single term, the mode conversion, since they usually arise due to a same cause, e.g., the presence of the inter-coil capacitance disclosed herein. Therefore, solving the problems raised by the inter-coil capacitance can improve both of the two mode conversions in the meantime, which subsequently improves the aforementioned problem of unstable power delivery, erroneous data processing, and EMI, as being applied to a PoE system or the like.

An embodiment provides an apparatus of coupled inductors. The apparatus includes a first electrode and a second electrode disposed on a first terminal location along an axis direction, a third electrode and a fourth electrode disposed on a second terminal location along the axis direction, a first wrapping region and a second wrapping region located along the axis direction, a first coil wrapped in the first wrapping region, and a second coil wrapped in the second wrapping region. The first coil includes a first winding leg having a first end connected to the second electrode and a second end extending towards the second wrapping region, and a second winding leg having a first end connected to the first winding leg and a second end extending towards the first terminal location for connecting to the first electrode. The second coil includes a third winding leg having a first end connected to the third electrode and a second end extending towards the first wrapping region, and a fourth winding leg having a first end connected to the third winding leg and a second end extending towards the second terminal location for connecting to the fourth electrode. The first terminal location and the second terminal location are on opposite sides of the axis direction. The first wrapping region is between the first terminal location and the second wrapping region. The second wrapping region is between the second terminal location and the first wrapping region.

Another embodiment provides an apparatus of coupled inductors. The apparatus includes a first electrode and a second electrode disposed on a first terminal location along an axis direction, a third electrode and a fourth electrode disposed on a second terminal location along the axis direction, a first wrapping region and a second wrapping region located along the axis direction, a first coil wrapped in the first wrapping region, a second coil wrapped in the second wrapping region, and a compensation capacitor coupled between the first coil and the second coil. The first coil includes a first winding leg having a first end connected to the first electrode and a second end extending towards the second wrapping region, and a second winding leg having a first end connected to the first winding leg and a second end connected to the second electrode. The second coil includes a third winding leg having a first end connected to the third electrode and a second end extending towards the first wrapping region, and a fourth winding leg having a first end connected to the third winding leg and a second end connected to the fourth electrode. The first terminal location and the second terminal location are on opposite sides of the axis direction. The first wrapping region is between the first terminal location and the second wrapping region. The second wrapping region is between the second terminal location and the first wrapping region.

Another embodiment provides an apparatus of coupled inductors. The apparatus includes a first electrode disposed on a first terminal location along an axis direction, a second electrode disposed on a second terminal location along the axis direction, a third electrode disposed on the second terminal location, a fourth electrode disposed on the first terminal location, a first wrapping region and a second wrapping region located along the axis direction, a first coil, a second coil, and a compensation capacitor coupled between the first coil and the second coil. The first coil includes a first winding leg wrapped in the first wrapping region and including a first end connected to the fourth electrode and a second end extending towards the second wrapping region, and a second winding leg having a first end connected to the first winding leg and a second end connected to the third electrode. The second coil includes a third winding leg wrapped in the second wrapping region and including a first end connected to the second electrode and a second end extending towards the first wrapping region, and a fourth winding leg having a first end connected to the third winding leg and a second end connected to the first electrode. The first terminal location and the second terminal location are on opposite sides of the axis direction. The first wrapping region is between the first terminal location and the second wrapping region. The second wrapping region is between the second terminal location and the first wrapping region.

These and other objectives of the present invention will no doubt become obvious to those of ordinary skill in the art after reading the following detailed description of the preferred embodiment that is illustrated in the various figures and drawings.

DETAILED DESCRIPTION

FIGS. 1-6 are diagrams illustrating the structure of the inductor set for implementing the apparatus of coupled inductors according to embodiments of the present invention. Each inductor set includes four electrodes P1~P4, two coils W1~W2, and a material body. The coils W1~W2 can generate magnetic flux along an axis direction indicated by an arrow $S_{AXIS}$. For illustrative purposes, A1 represents a first terminal location along the axis direction, A2 represents a second terminal location along the axis direction, B1 represents a first wrapping region along the axis direction, and B2 represents a second wrapping region along the axis direction.

Figure 1:
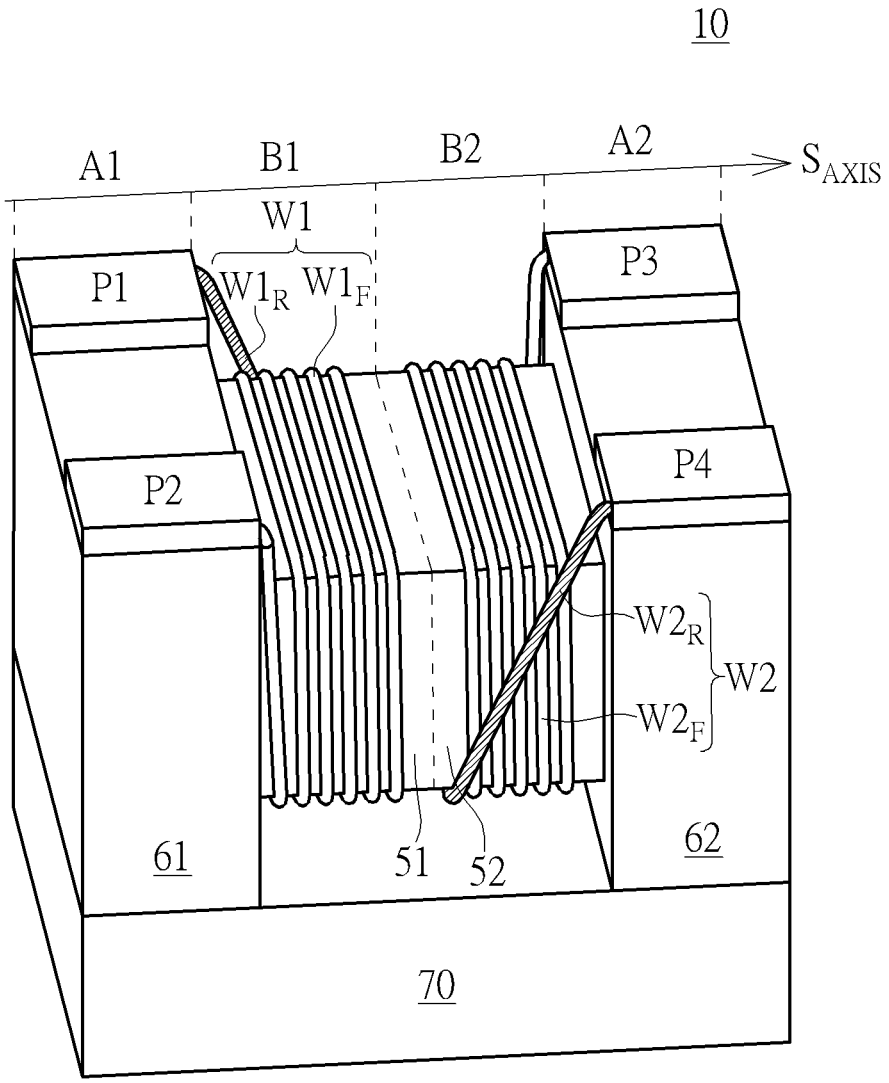
FIG. 1 is a diagram illustrating the structure of the inductor set in the apparatus of coupled inductors according to an embodiment of the present invention.
Figure 2:
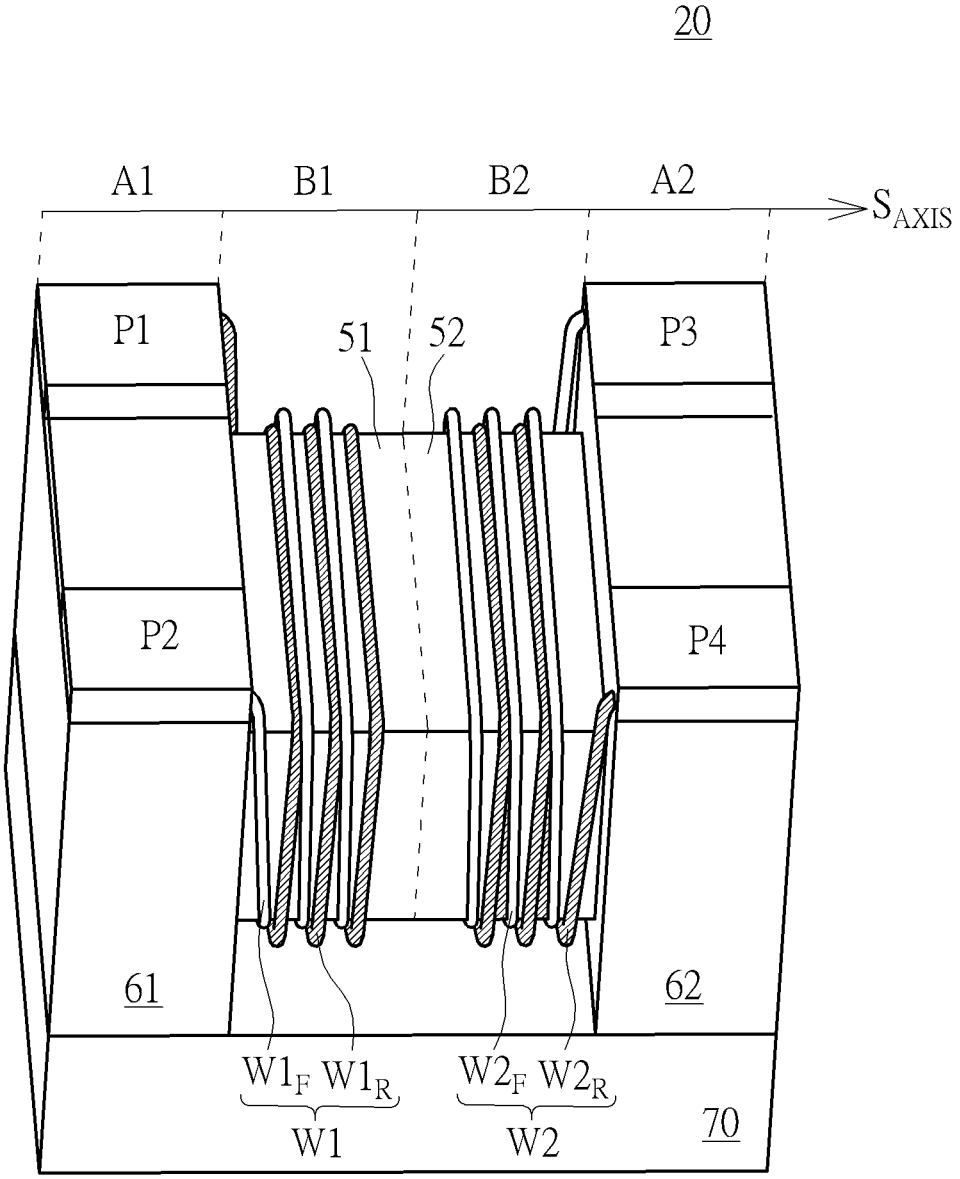
FIG. 2 is a diagram illustrating the structure of the inductor set in the apparatus of coupled inductors according to an embodiment of the present invention.
Figure 3:
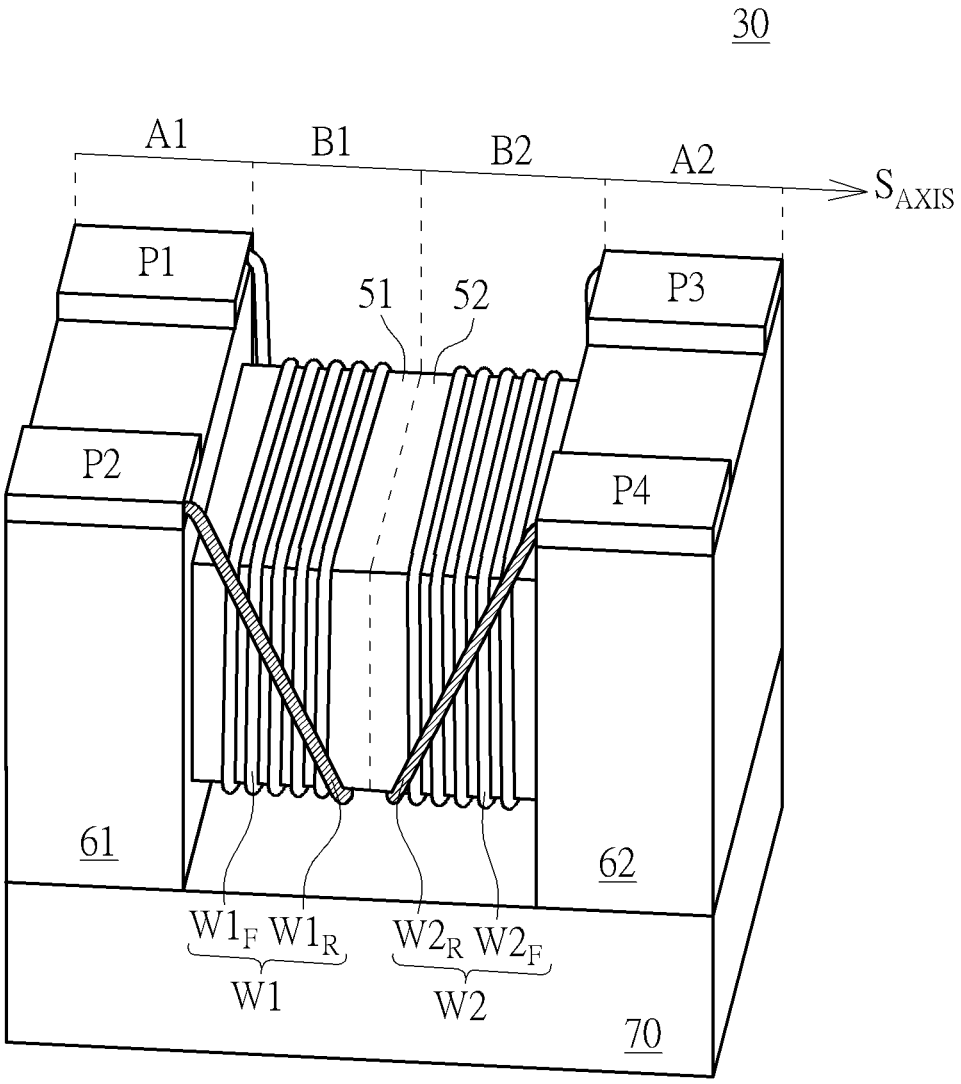
FIG. 3 is a diagram illustrating the structure of the inductor set in the apparatus of coupled inductors according to another embodiment of the present invention.
Figure 4:
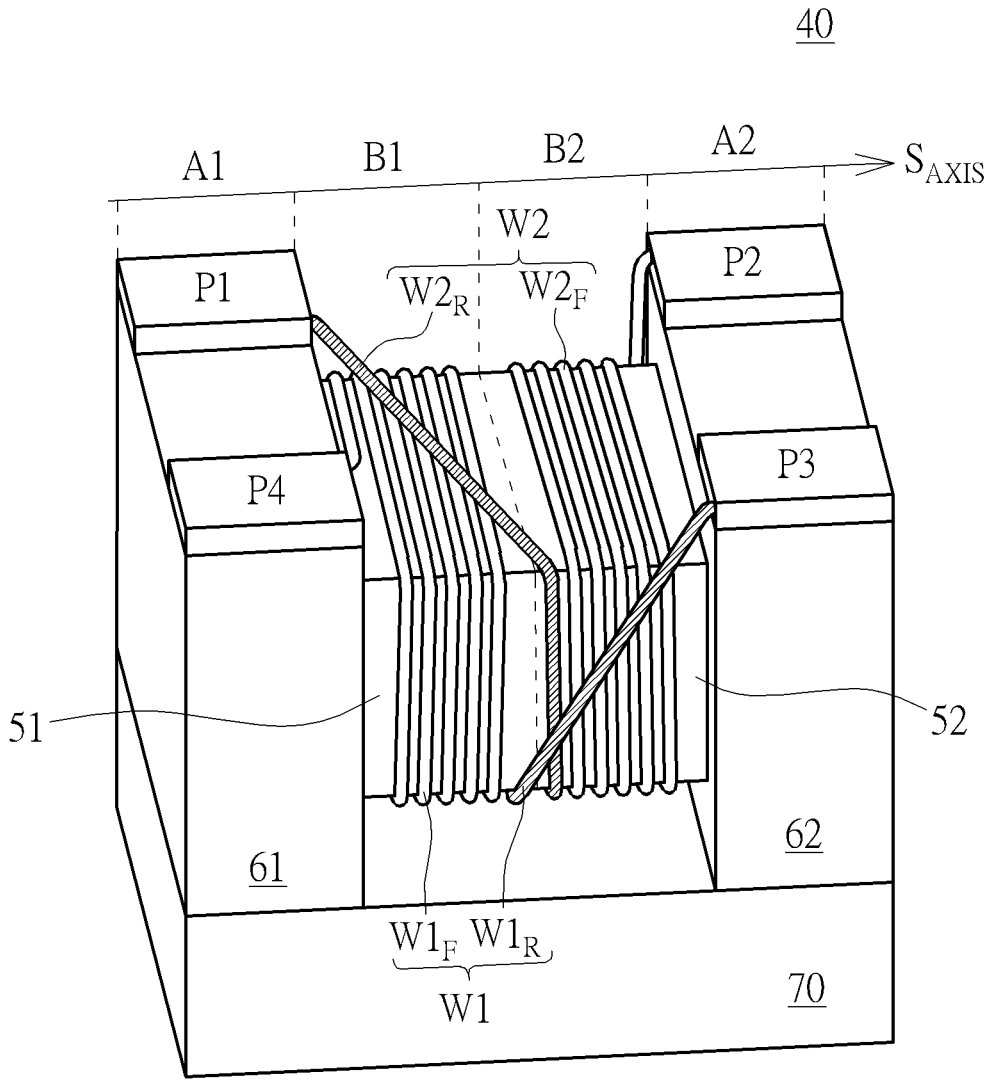
FIG. 4 is a diagram illustrating the structure of the inductor set in the apparatus of coupled inductors according to another embodiment of the present invention.

In the embodiments illustrated in FIGS. 1-4, the material body includes a first core 51, a second core 52, a first terminal part 61, a second terminal part 62, and a pedestal part 70. The coil W1 includes a first winding leg $W1_F$ and a second winding leg $W1_R$. The coil W2 includes a third winding leg $W2_F$ and a fourth winding leg $W2_R$. In FIGS. 1-3, the electrodes P1 and P2 are disposed on the first terminal part 61 which is disposed on the pedestal part 70 on the first terminal location A1. The electrodes P3 and P4 are disposed on the second terminal part 62 which is disposed on the pedestal part 70 on the second terminal location A2. In FIG. 4, the electrodes P1 and P4 are disposed on the first terminal part 61 which is disposed on the pedestal part 70 on the first terminal location A1. The electrodes P2 and P3 are disposed on the second terminal part 62 which is disposed on the pedestal part 70 on the second terminal location A2.

Figure 5:
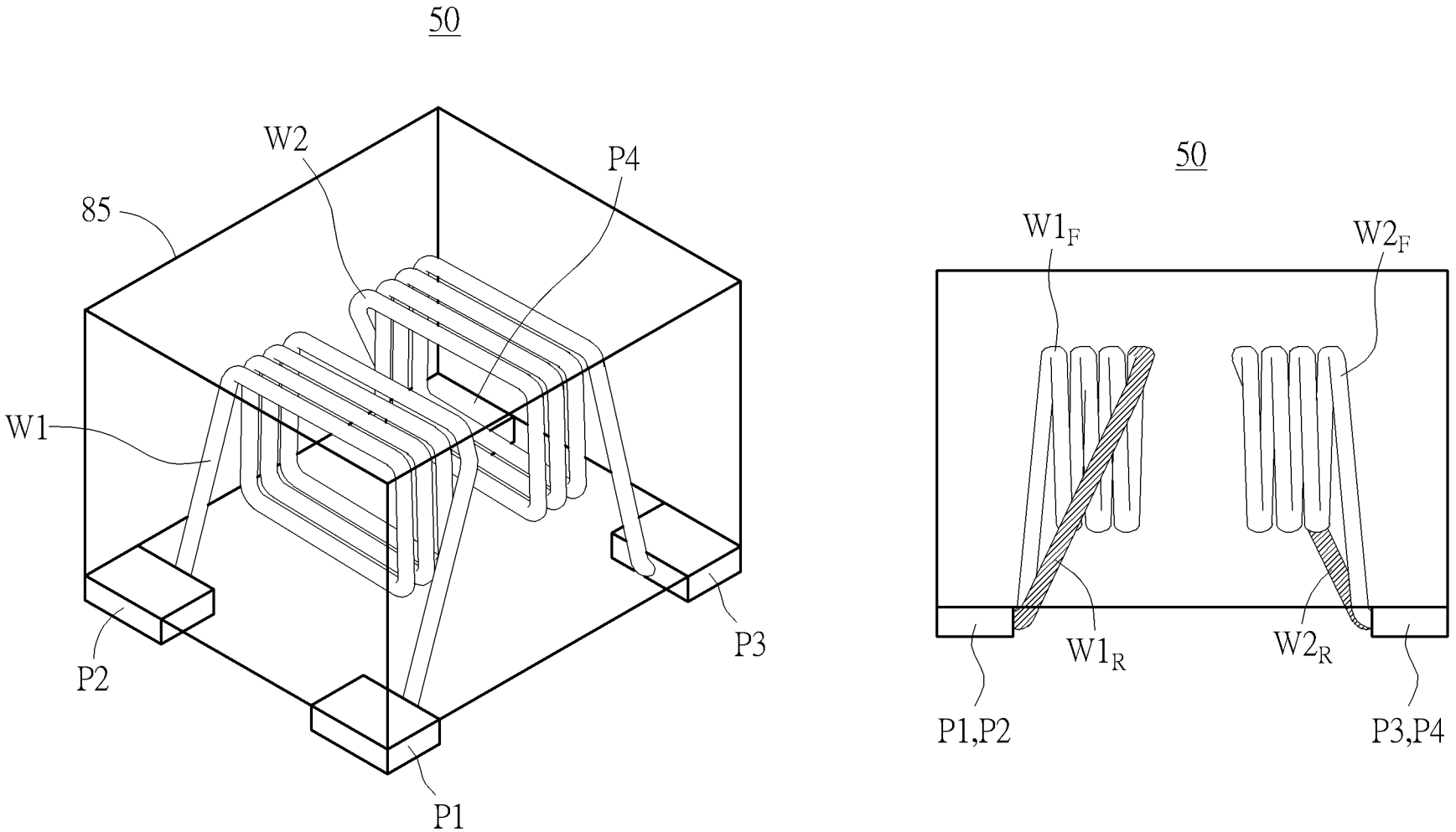
FIG. 5 is a diagram illustrating the structure of the inductor set in the apparatus of coupled inductors according to another embodiment of the present invention.
Figure 6:
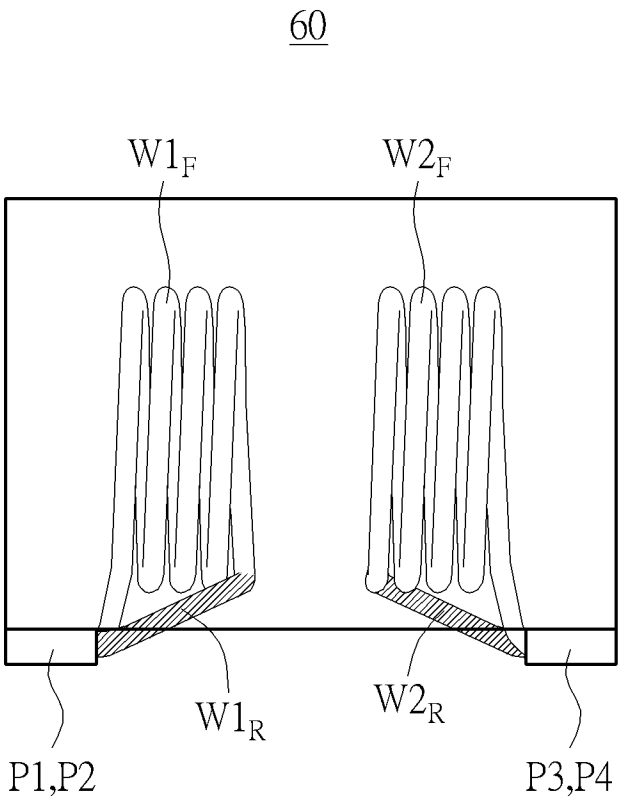
FIG. 6 is a diagram illustrating the structure of the inductor set in the apparatus of coupled inductors according to another embodiment of the present invention.
Figure 6:
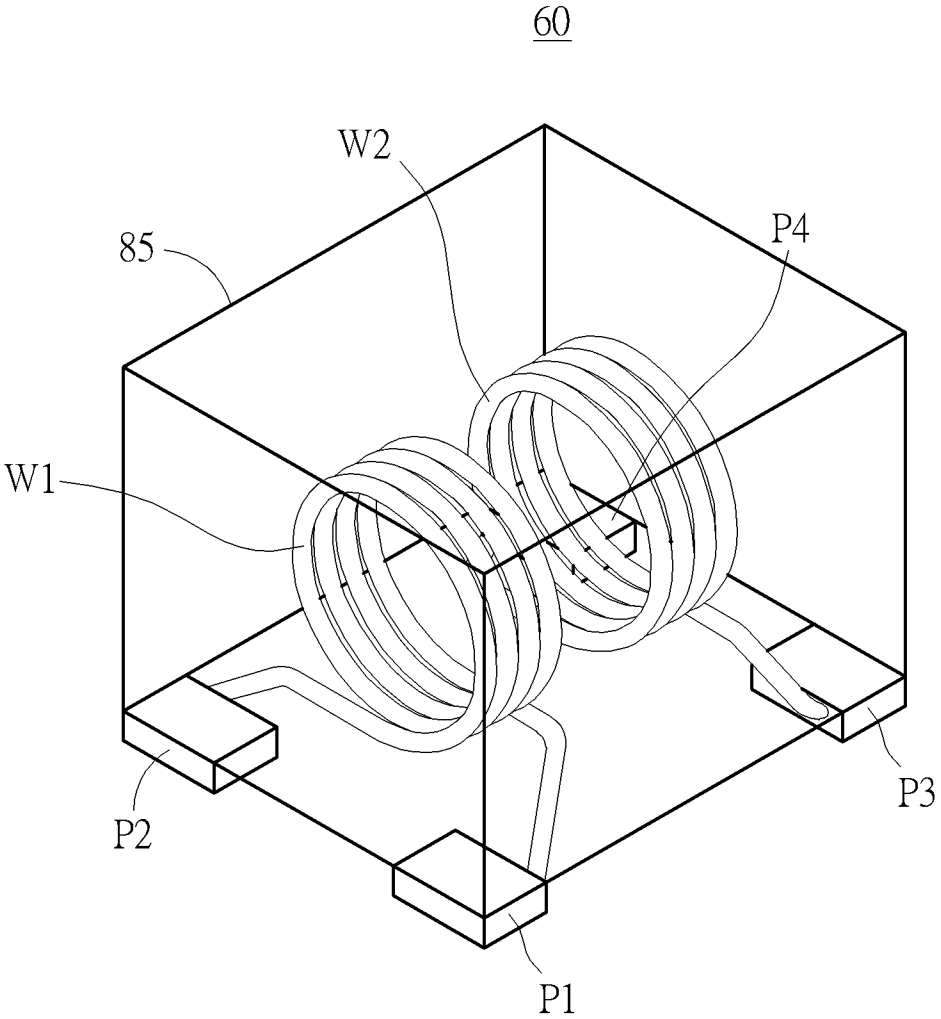

In the embodiments illustrated in FIGS. 5-6, the material body includes a covering part 85 for containing or enclosing the first coil W1 and the second coil W2. The coil W1 includes a first winding leg $W1_F$ and a second winding leg $W1_R$. The coil W2 includes a third winding leg $W2_F$ and a fourth winding leg $W2_R$. In an embodiment, the covering part 85 may be a case for containing the first coil W1 and the second coil W2 which have fixed shapes and are disposed at fixed locations. In another embodiment, the covering part 85 may be filled with any material for enclosing the first coil W1 and the second coil W2 so that the first coil W1 and the second coil W2 can be further secured at fixed locations and in fixed shapes. However, the implementation of the covering part 85 does not limit the scope of the present invention.

In the inductor sets 10 and 20 illustrated in FIGS. 1-2, the coil W1 is wrapped around the first core 51 in the first wrapping region B1, whereas the coil W2 is wrapped around the second core 52 in the second wrapping region B2. The first end of the first winding leg $W1_F$ is connected to the electrode P2 and the second end of the first winding leg $W1_F$ extends towards the second wrapping region B2. The first end of the second winding leg $W1_R$ is connected to the first winding leg $W1_F$ and the second end of the second winding leg $W1_R$ is connected to the electrode P1. The first end of the third winding leg $W2_F$ is connected to the electrode P3, and the second end of the third winding leg $W2_F$ extends towards the first wrapping region B1. The first end of the fourth winding leg $W2_R$ is connected to the third winding leg $W2_F$, and the second end of the fourth winding leg $W2_R$ is connected to the electrode P4. More specifically, the first winding leg $W1_F$ is the forward-winding portion of the coil W1, while the second winding leg $W1_R$ is the reverse-winding portion of the coil W1. The third winding leg $W2_F$ is the forward-winding portion of the coil W2, while the fourth winding leg $W2_R$ is the reverse-winding portion of the coil W2. The electrodes P1-P4 are disposed on four corners of a quadrilateral, wherein a line between the electrodes P1 and P4 and a line between the electrodes P2 and P3 correspond to the diagonals of the quadrilateral. Looking into the axis direction as indicated by the arrow $S_{AXIS}$, the coil W1 is wrapped along the axis direction in a clockwise manner and the coil W2 is wrapped along the axis direction in a counter-clockwise manner. In the coil W1, the first winding leg $W1_F$ is overlapped with the second winding leg $W1_R$. In the coil W2, the third winding leg $W2_F$ is overlapped with the fourth winding leg $W2_R$.

In the inductor set 30 illustrated in FIG. 3, the coil W1 is wrapped around the first core 51 in the first wrapping region B1, whereas the coil W2 is wrapped around the second core 52 in the second wrapping region B2. The first end of the first winding leg $W1_F$ is connected to the electrode P1 and the second end of the first winding leg $W1_F$ extends towards the second wrapping region B2. The first end of the second winding leg $W1_R$ is connected to the first winding leg $W1_F$ and the second end of the second winding leg $W1_R$ is connected to the electrode P2. The first end of the third winding leg $W2_F$ is connected to the electrode P3, and the second end of the third winding leg $W2_F$ extends towards the first wrapping region B1. The first end of the fourth winding leg $W2_R$ is connected to the third winding leg $W2_F$, and the second end of the fourth winding leg $W2_R$ is connected to the electrode P4. More specifically, the first winding leg $W1_F$ is the forward-winding portion of the coil W1, while the second winding leg $W1_R$ is the reverse-winding portion of the coil W1. The third winding leg $W2_F$ is the forward-winding portion of the coil W2, while the fourth winding leg $W2_R$ is the reverse-winding portion of the coil W2.

In the inductor set 40 illustrated in FIG. 4, the first winding leg $W1_F$ of the coil W1 is wrapped around the first core 51 in the first wrapping region B1, and the third winding leg $W2_F$ of the coil W2 is wrapped around the second core 52 in the second wrapping region B2. The first end of the first winding leg $W1_F$ is connected to the electrode P4, and the second end of the first winding leg $W1_F$ extends towards the second wrapping region B2. The first end of the second winding leg $W1_R$ is connected to the first winding leg $W1_F$, and the second end of the second winding leg $W1_R$ is connected to the electrode P3. The first end of the third winding leg $W2_F$ is connected to the electrode P2, and the second end of the third winding leg $W2_F$ extends towards the first wrapping region B1. The first end of the fourth winding leg $W2_R$ is connected to the third winding leg $W2_F$, and the second end of the fourth winding leg $W2_R$ is connected to the electrode P1. More specifically, the first winding leg $W1_F$ is the start-winding portion of the coil W1, while the second winding leg $W1_R$ is the end-winding portion of the coil W1. The third winding leg $W2_F$ is the start-winding portion of the coil W2, while the fourth winding leg $W2_R$ is the end-winding portion of the coil W2.

In the inductor set 50 illustrated in FIG. 5, the coil W1 is wrapped into rectangular windings and contained/enclosed in the covering part 85 in the first wrapping region B1, whereas the coil W2 is wrapped into rectangular windings and contained/enclosed in the covering part 85 in the second wrapping region B2. The layout of the electrodes P1~P4 and the coils W1~W2 in the inductor set 50 illustrated in FIG. 5 is the same as that of the inductor set 10 illustrated in FIG. 1. However, the shape of the windings in the coils W1 and W2 does not limit the scope of the present invention.

In the inductor set 60 illustrated in FIG. 6, the coil W1 is wrapped into circular windings and contained/enclosed in the covering part 85 in the first wrapping region B1, whereas the coil W2 is wrapped into circular windings and contained/enclosed in the covering part 85 in the second wrapping region B2. The layout of the electrodes P1~P4 and the coils W1~W2 in the inductor set 60 illustrated in FIG. 6 is the same as that of the inductor set 10 illustrated in FIG. 1. However, the shape of the windings in the coils W1 and W2 does not limit the scope of the present invention.

In the present invention, the first winding leg $W1_F$ of the coil W1 includes M1 windings, the second winding leg $W1_R$ of the coil W1 includes N1 windings, the third winding leg $W2_F$ of the coil W2 includes M2 windings, and the fourth winding leg $W2_R$ of the coil W2 includes N2 windings, wherein M1 N1, M2 and N2 are positive numbers.

In the inductor set 10 illustrated in FIG. 1, $|M1-M2|/M1$ is equal to or smaller than 0.25, $|N1-N2|/N1$ is equal to or smaller than 0.25, M1 is larger than or equal to M2, and N1 is larger than or equal to N2. FIG. 1 depicts the embodiment when M1=M2=6 and N1=N2=0.5, but does not limit the scope of the present invention.

In the inductor set 20 illustrated in FIG. 2, M1=M2=N1=N2. FIG. 2 depicts the embodiment when M1=M2=N1=N2=3, but does not limit the scope of the present invention.

In the inductor sets 30 and 40 illustrated in FIGS. 3-4, M1, N1, M2 and N2 may be any suitable positive numbers according to design requirement. FIGS. 3-4 depict the embodiment when M1=M2=6 and N1=N2=0.5, but does not limit the scope of the present invention.

In the inductor sets 50 and 60 illustrated in FIGS. 5 and 6, |M1−M2|/M1 is equal to or smaller than 0.25, and |N1−N2|/N1 is equal to or smaller than 0.25. FIGS. 5 and 6 depict the embodiment when M1=M2=4 and N1=N2=0.5, but does not limit the scope of the present invention.

As well-known to those skilled in the art, the strength of the magnetic field induced by a conductive coil depends upon the amount of current flowing through the coil, the material of the conductive coil, and the number of windings. In an embodiment, the coils W1 and W2 are implemented by the same type of wires. However, the type of material does not limit the scope of the present invention.

Figure 7:
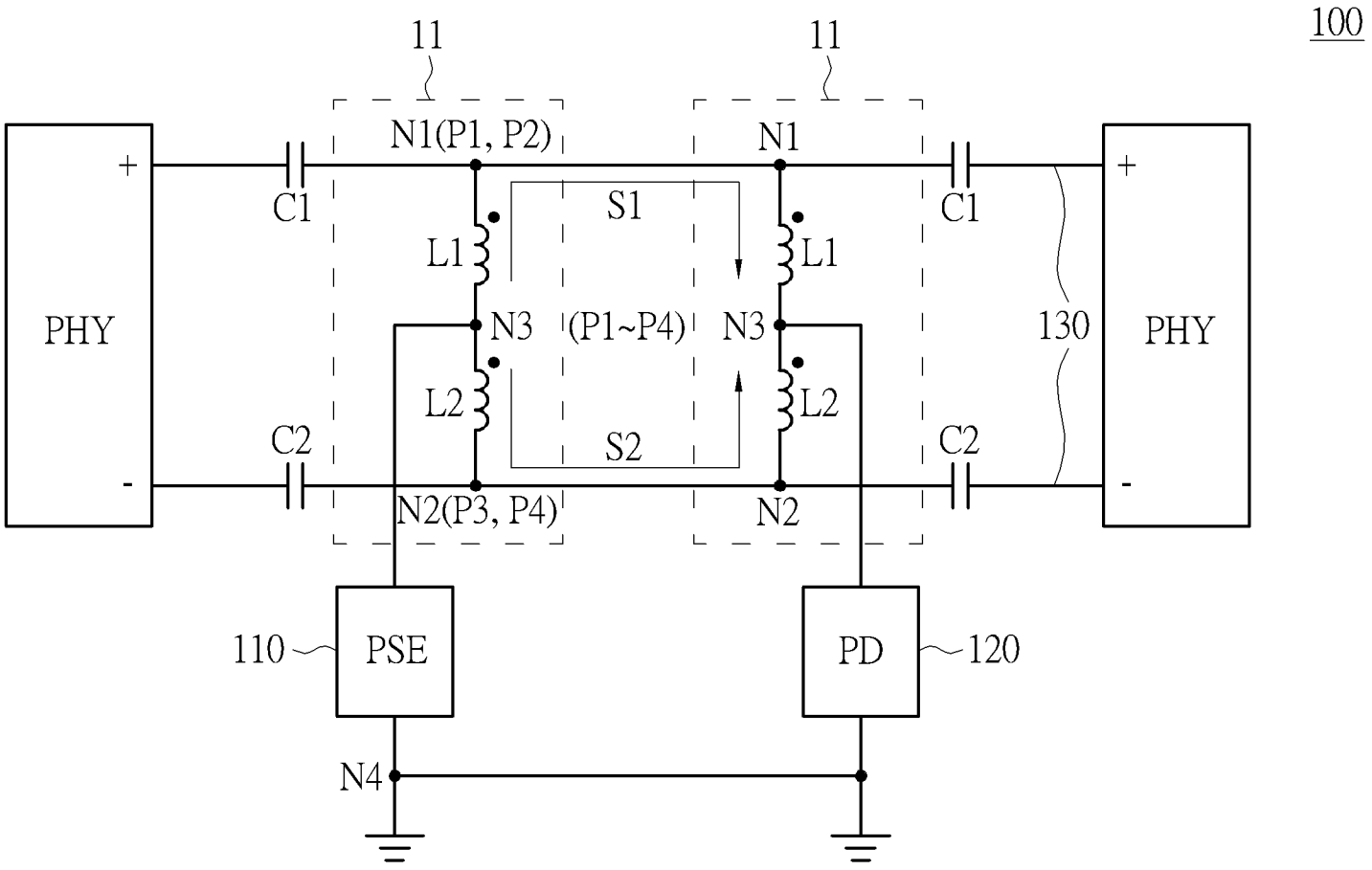
FIG. 7 is a diagram illustrating an apparatus of coupled inductors for use in a PoE system according to an embodiment of the present invention.
Figure 8:
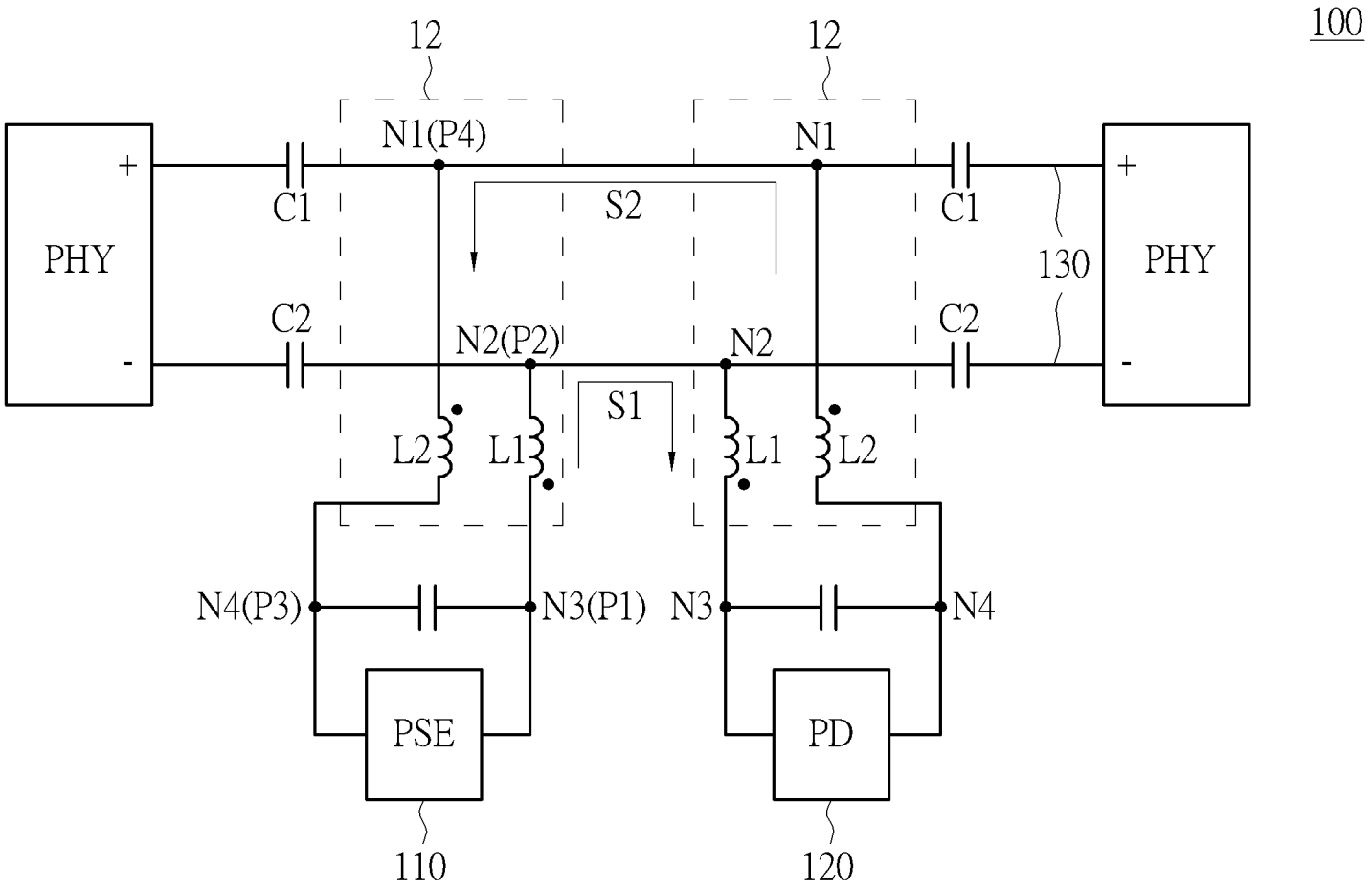
FIG. 8 is a diagram illustrating an apparatus of coupled inductors for use in a PoE system according to another embodiment of the present invention.
Figure 9:
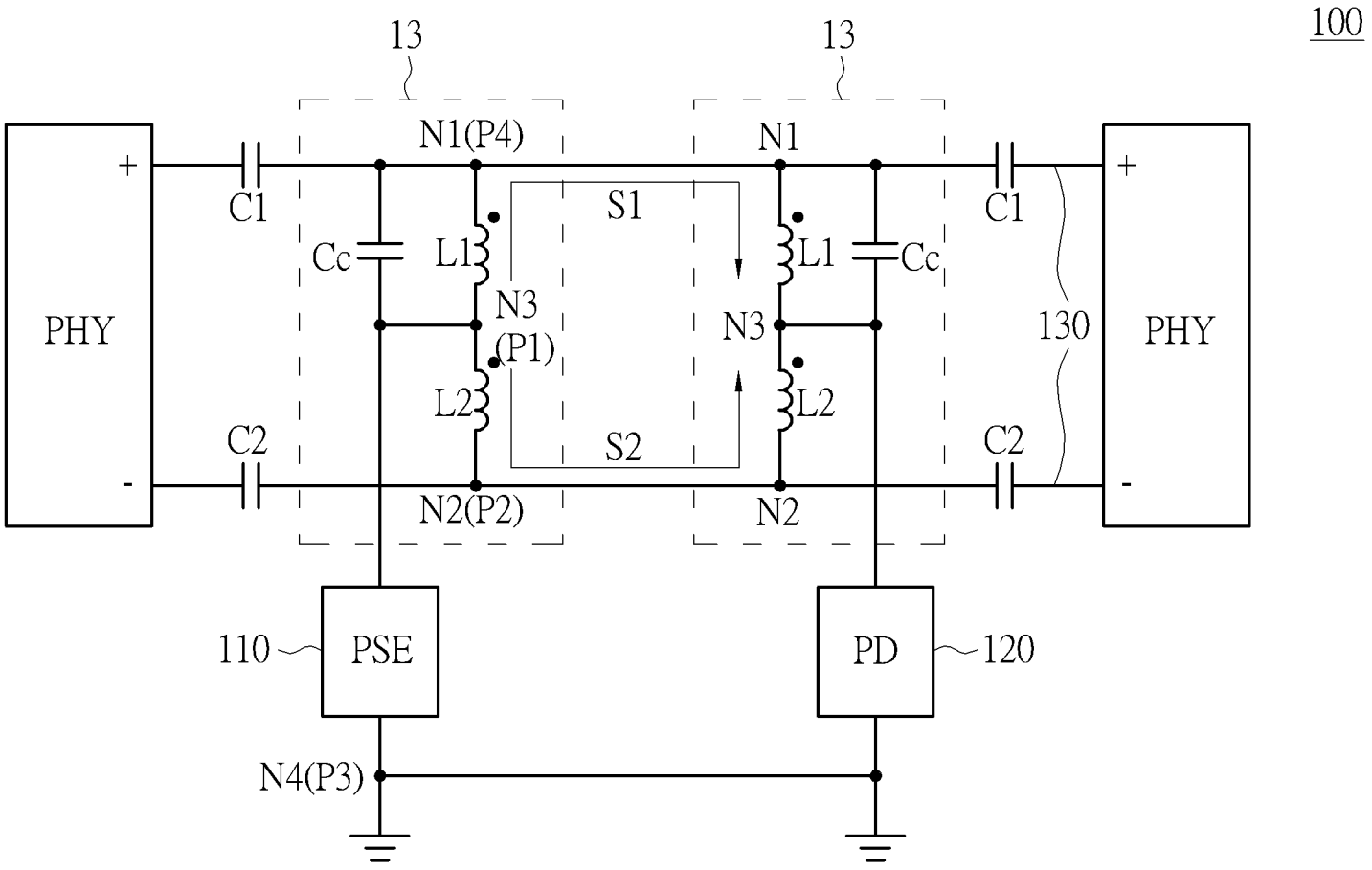
FIG. 9 is a diagram illustrating an apparatus of coupled inductors for use in a PoE system according to another embodiment of the present invention.

The inductor sets depicted in FIGS. 1, 2, 5 and 6 may be directly implemented as apparatus of coupled inductors 11-13 in various configurations for use in a PoE system 100 depicted in FIGS. 7-9. The inductor sets depicted in FIGS. 3 and 4 may be implemented as the apparatus of coupled inductors 11-13 along with a compensation capacitor in various configurations for use in the PoE system 100 depicted in FIGS. 7-9. The PoE system 100 includes a power sourcing equipment (PSE) 110, a powered device (PD) 120 and one or multiple data-carrying wire pairs.

According to PoE and PoDL standards set out in IEEE 802.03, the PSE 110 can transmit power to the PD 120 over one or multiple data-carrying wire pairs that would also be used for data transmission between physical layers PHY. As would be appreciated, PHY specifications such as 1000BASE-T and 10GBASE-T are configured to use four data-carrying wire pairs. Moreover, some PoE system can be configured to deliver power over four data-carrying wire pairs. For purposes of illustration, only a single data-carrying wire pair 130 is shown in FIGS. 7-9 for simplicity. However, the number of data-carrying wire pairs does not limit the scope of the present invention.

Each of the apparatuses of coupled inductors 11-13 may include inductors L1-L2 for blocking AC signals in the power transmission path of the data-carrying wire pair 130. The PoE system 100 may further include capacitors C1-C2 for blocking DC signals in the data transmission path of the data-carrying wire pair 130. For common-mode signals, the power transmission path of the data-carrying wire pair 130 includes a first power path (indicated by the arrow S1) and a second power path (indicated by the arrow S2).

Figure 10:
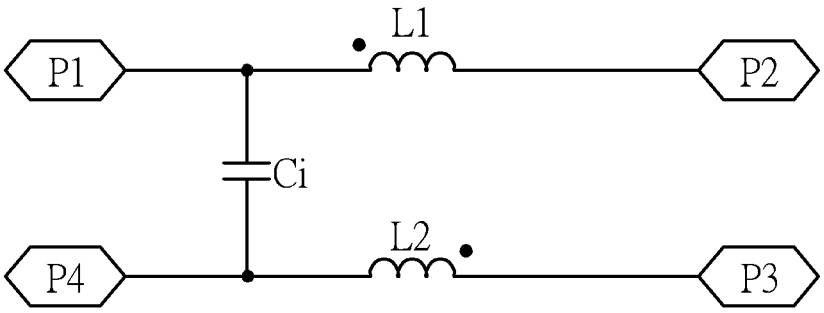
FIG. 10 is a diagram illustrating an equivalent circuit of an apparatus of coupled inductors in a configuration according to an embodiment of the present invention.

In a first configuration when any of the inductor sets 10, 50 and 60 is implemented in the apparatus of coupled inductors 11 for use in the PoE system 100 depicted in FIG. 7, the corresponding equivalent circuit of the inductor set is depicted in FIG. 10. The electrodes P1 and P4 are coupled to the positive terminal (node N3) of the PSE 110 or the PD 120, the electrode P2 is coupled to the positive terminal (node N1) of the data-carrying wire pair 130, and the electrode P3 is coupled to the negative terminal (node N2) of the data-carrying wire pair 130.

In a second configuration when any of the inductor sets 10, 50 and 60 is implemented in the apparatus of coupled inductors 12 for use in the PoE system 100 depicted in FIG. 8, the corresponding equivalent circuit of the inductor set is depicted in FIG. 10. The electrode P1 is coupled to the positive terminal (node N3) of the PSE 110 or the PD 120, the electrode P2 is coupled to the negative terminal (node N2) of the data-carrying wire pair 130, the electrode P3 is coupled to the negative terminal (node N4) of the PSE 110 or the PD 120, and the electrode P4 is coupled to the positive terminal (node N1) of the data-carrying wire pair 130.

In a third configuration when any of the inductor sets 10, 50 and 60 is implemented in the apparatus of coupled inductors 11 for use in the PoE system 100 depicted in FIG. 7, the corresponding equivalent circuit of the inductor set is depicted in FIG. 10. The electrodes P2 and P3 are coupled to the positive terminal (node N3) of the PSE 110 or the PD 120, the electrode P1 is coupled to the positive terminal (node N1) of the data-carrying wire pair 130, and the electrode P4 is coupled to the negative terminal (node N2) of the data-carrying wire pair 130.

As depicted in the equivalent circuit of FIG. 10 corresponding to the first through third configurations, the two coils W1~W2 can be symmetrically disposed, and windings of the coil W1 and windings of the coil W2 closest to one another can be symmetrically disposed to form a parasitic capacitor Ci with an inter-coil capacitance. The inter-coil capacitance established between the electrodes P1 and P4 substantially by the windings of the coil W1 and the windings of the coil W2 closest to one another is a balanced capacitance so that electromotive forces induced by the inductance L1 of the coil W1 and the inductance L2 of the coil W2 at the electrodes P1 and P4 are substantially equal. When the common-mode noise impinges the inductor sets 10, 50 and 60, the two AC current portions of the noise induce two electromotive forces (EMFs) of equal amplitude in a same direction, each over the corresponding coil, as the inductances L1 and L2 being equal, and the inter-coil capacitance being formed between the closest portions of the two coils W1~W2. The inter-coil capacitance can keep the two EMFs equal in amplitude since the potentials at the windings of the coil W1 and the windings of the coil W2 closest to one another can be kept substantially equal due to the above described symmetrical allocation, which does not drive a bypass current flowing through the parasitic capacitor Ci between the electrodes P1 and P4 to ruin the equality of EMF amplitude. Then the two EMFs produce a zero potential difference between the electrodes P1 and P4, which minimizes the differential-mode interference, or equivalently prevents the common-mode noise from being converted into the differential-mode interference. Having the inter-coil capacitance formed between the electrodes P1 and P4 can also make potentials at the electrodes P1 and P4 equal in amplitude but opposite in polarity to produce a zero potential sum as the apparatus of coupled inductors 11 carries the differential-mode data signal, thus preventing the common-mode interference from being converted. Therefore, the present invention can improve the stability of the power delivery system and quality of data processing system in the PoE system 100, and can eliminate a source of EMI.

Figure 11:
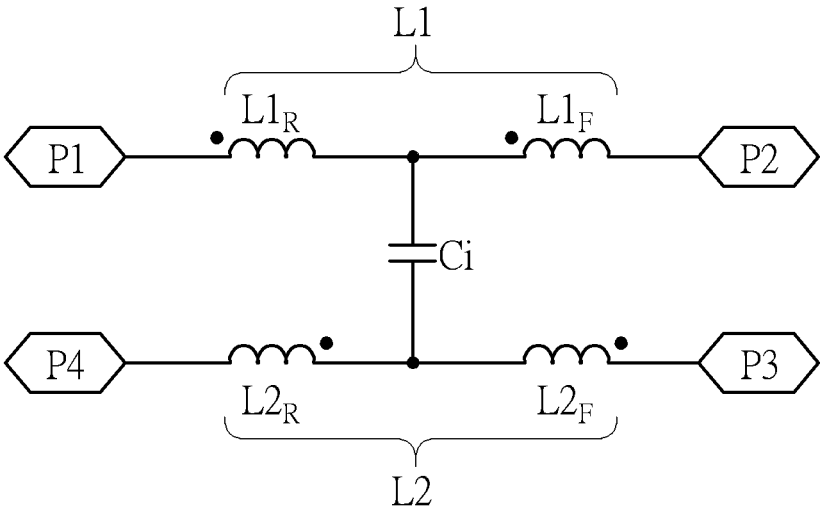
FIG. 11 is a diagram illustrating an equivalent circuit of an apparatus of coupled inductors in another configuration according to another embodiment of the present invention.

In a fourth configuration when the inductor set 20 is implemented in the apparatus of coupled inductors 11 for use in the PoE system 100 depicted in FIG. 7, the corresponding equivalent circuit of the inductor set 20 is depicted in FIG. 11. The electrodes P1 and P4 are coupled to the positive terminal (node N3) of the PSE 110 or the PD 120, the electrode P2 is coupled to the positive terminal (node N1) of the data-carrying wire pair 130, and the electrode P3 is coupled to the negative terminal (node N2) of the data-carrying wire pair 130. $L1_F$ represents the inductance induced by the first winding leg $W1_F$ of the coil W1 (M1 windings), $L1_R$ represents the inductance induced by the second winding leg $W1_R$ of the coil W1 (N1 windings), $L2_F$ represents the inductance induced by the third winding leg $W2_F$ of the coil W2 (M2 windings), and $L2_R$ represents the inductance induced by the fourth winding leg $W2_R$ of the coil W2 (N2 windings).

In a fifth configuration when the inductor set 20 is implemented in the apparatus of coupled inductors 12 for use in the PoE system 100 depicted in FIG. 8, the corresponding equivalent circuit of the inductor set 20 is depicted in FIG. 11. The electrode P1 is coupled to the positive terminal (node N3) of the PSE 110 or the PD 120, the electrode P2 is coupled to the negative terminal (node N2) of the data-carrying wire pair 130, the electrode P3 is coupled to the positive terminal (node N1) of the data-carrying wire pair 130, and the electrode P4 is coupled to the negative terminal (node N4) of the PSE 110 or the PD 120. $L1_F$ represents the inductance induced by the first winding leg $W1_F$ of the coil W1 (M1 windings), $L1_R$ represents the inductance induced by the second winding leg $W1_R$ of the coil W1 (N1 windings), $L2_F$ represents the inductance induced by the third winding leg $W2_F$ of the coil W2 (M2 windings), and $L2_R$ represents the inductance induced by the fourth winding leg $W2_R$ of the coil W2 (N2 windings).

As depicted in the corresponding equivalent circuit of FIG. 11 corresponding to the fourth and fifth configurations, the two coils W1~W2 can be symmetrically disposed, and windings of the coil W1 and windings of the coil W2 closest to one another can be symmetrically disposed to form an parasitic capacitor Ci with an inter-coil capacitance. The inter-coil capacitance is a balanced capacitance so that electromotive forces induced by the inductance L1 of the coil W1 and the inductance L2 of the coil W2 at the windings of the coil W1 and the windings of the coil W2 closest to one another (two ends of the parasitic capacitor Ci) are substantially equal. This can avoid undesirable noise emissions due to differential to common-mode conversion. The inter-coil capacitance can keep two EMFs equal in amplitude since the potentials at both ends of the parasitic capacitor Ci can be kept substantially equal due to the above described symmetrical allocation, which does not drive a bypass current flowing through the parasitic capacitor Ci to ruin the equality of EMF amplitude. Then the two EMFs produce a zero potential difference between the two ends of the parasitic capacitor Ci, which minimizes the differential-mode interference, or equivalently prevents the common-mode noise from being converted into the differential-mode interference. Having the parasitic capacitor Ci can also make potentials at the two ends of the parasitic capacitor Ci equal in amplitude but opposite in polarity to produce a zero potential sum as the apparatus of coupled inductors 11 carries the differential-mode data signal, thus preventing the common-mode interference from being converted. Therefore, the present invention can improve the stability of the power delivery system and quality of data processing system in the PoE system 100, and can eliminate a source of EMI.

The inductor set 30 depicted in FIG. 3 may be implemented in the apparatus of coupled inductors 13 along with a compensation capacitor $C_C$ for use in the PoE system 100 depicted in FIG. 9. As depicted in the corresponding equivalent circuit of FIG. 12, windings of the coil W1 and windings of the coil W2 closest to one another are disposed to form a parasitic capacitor Ci with an inter-coil capacitance between the electrodes P2 and P4. The inter-coil capacitance is an unbalanced capacitance, which may drive a bypass current through the parasitic capacitor Ci. The effect of the inter-coil capacitance can be compensated by a compensation capacitor Cc, disposed symmetrically with respect to the parasitic capacitor Ci between the two coils W1, W2. More specifically, the compensation capacitor Cc is coupled between the electrodes P1 and P3 so as to compensate the effect of the parasitic capacitor Ci between the electrodes P2 and P4. The compensation capacitor Cc is utilized to draw a bypass current of an amount equal to the bypass current through the parasitic capacitor Ci so as to retrieve the amplitude equality of both EMFs induced over the two coils W1, W2, no matter when the two coils are impinged by the common-mode noise or carry the differential-mode data signal. The two EMFs induced by the common-mode noise are therefore compensated to be equal in amplitude so as to produce a zero potential difference between the electrodes P1 and P4, and between the electrodes P2 and P3, which minimizes the differential-mode interference, or equivalently prevents the common-mode noise from being converted into the differential-mode interference. Similarly, the two EMFs induced by the differential-mode data signal are therefore compensated to make potentials at the electrodes P1 and P4 equal in amplitude but opposite in polarity to produce a zero potential sum, and to make potentials at the electrodes P2 and P3 equal in amplitude but opposite in polarity to produce another zero potential sum, which minimizes the common-mode interference, or equivalently prevents the differential-mode data signal from being converted into the common-mode interference. Therefore, the present invention can improve the stability of the power delivery system and quality of data processing system in the PoE system 100, and can eliminate a source of EMI.

The inductor set 40 depicted in FIG. 4 may be implemented in the apparatus of coupled inductors 13 along with a compensation capacitor $C_C$ for use in the PoE system 100 depicted in FIG. 9. As depicted in the equivalent circuit of FIG. 13, windings of the coil W1 and windings of the coil W2 closest to one another are disposed to form a parasitic capacitor Ci with an inter-coil capacitance between the electrodes P1 and P3. The inter-coil capacitance is an unbalanced capacitance, which may drive a bypass current through the parasitic capacitor Ci. The effect of the inter-coil capacitance can be compensated by a compensation capacitor Cc, disposed symmetrically with respect to the parasitic capacitor Ci between the two coils W1, W2. More specifically, the compensation capacitor Cc is coupled between the electrodes P2 and P4 so as to compensate the effect of the parasitic capacitor Ci between the electrodes P1 and P3. The compensation capacitor Cc is utilized to draw a bypass current of an amount equal to the bypass current through the parasitic capacitor Ci so as to retrieve the amplitude equality of both EMFs induced over the two coils W1, W2, no matter when the two coils are impinged by the common-mode noise or carry the differential-mode data signal. The two EMFs induced by the common-mode noise are therefore compensated to be equal in amplitude to produce a zero potential difference between the electrodes P1 and P4, and between the electrodes P2 and P3, which minimizes the differential-mode interference, or equivalently prevents the common-mode noise from being converted into the differential-mode interference. Similarly, the two EMFs induced by the differential-mode data signal are therefore compensated to make potentials at the electrodes P1 and P4 equal in amplitude but opposite in polarity to produce a zero potential sum, and to make potentials at the electrodes P2 and P3 equal in amplitude but opposite in polarity to produce another zero potential sum, which minimizes the common-mode interference, or equivalently prevents the differential-mode data signal from being converted into the common-mode interference. Therefore, the present invention can improve the stability of the power delivery system and quality of data processing system in the PoE system 100, and can eliminate a source of EMI.

Figure 12:
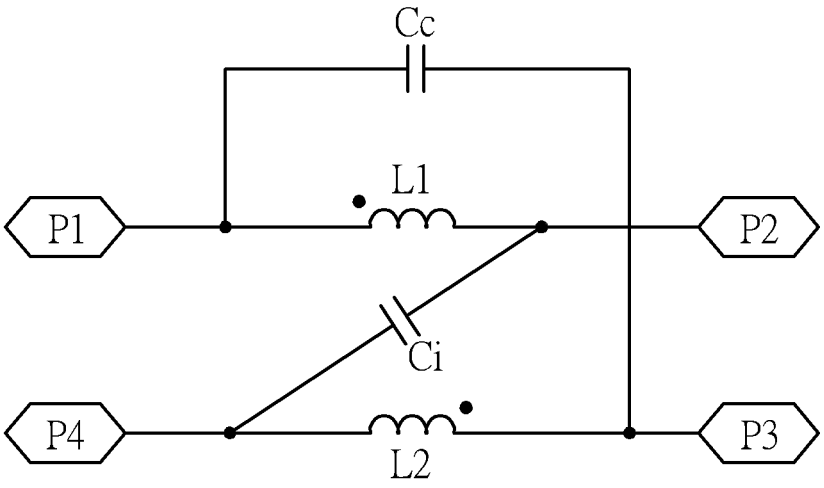
FIG. 12 is a diagram illustrating an equivalent circuit of an apparatus of coupled inductors in another configuration according to another embodiment of the present invention.
Figure 13:
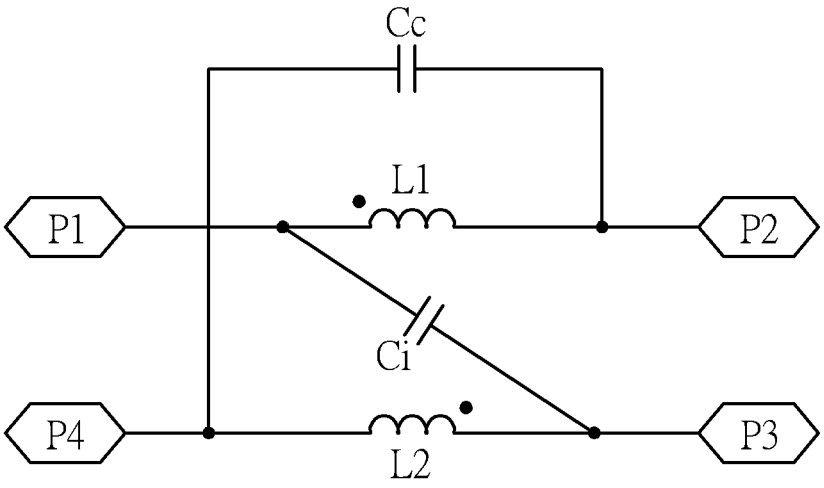
FIG. 13 is a diagram illustrating an equivalent circuit of an apparatus of coupled inductors in another configuration according to another embodiment of the present invention.

In the PoE system 100 depicted in FIG. 9 and its equivalent circuits related to various configurations as depicted in FIGS. 12-13, the capacitance of the compensation capacitor Cc is between 90% and 110% of the capacitance of the parasitic capacitor Ci. In a preferred embodiment, the capacitance of the compensation capacitor Cc is substantially equal to the capacitance of the parasitic capacitor Ci.

The apparatus of coupled inductors of the present invention may be implemented in the PoE system which includes a PSE, a PD and at least one data-carrying wire pair providing a first power path and a second power path between the PSE and the PD, as depicted in FIGS. 7-9. However, the apparatus of coupled inductors of the present invention may also be implemented in other power systems.

In the present invention, the apparatus of coupled inductors may include two coils W1, W2 arranged in a way so that the inter-coil capacitance between the coils W1 and W2 may keep the EMFs induced by the inductance L1 of the coil W1 and the inductance L2 of the coil W2 substantially equal. As the current bypasses an unbalanced parasitic capacitor Ci, the present invention teaches applying a compensation capacitor Cc between the two coils W1, W2 in order to retrieve the performance of balanced bypassing. The apparatus of coupled inductors including either the specific way of coil arrangement or the application of the compensation capacitor can keep the EMFs induced over the two inductances of two coils W1, W2 equal in amplitude, which prevents both the differential-mode and common-mode interference from being converted. Therefore, the apparatus of coupled inductors according to the present invention can improve the characteristics of mode conversion and is suitable to be utilized in a PoE system or the like.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus of coupled inductors, comprising:
- a material body having a first wrapping region and a second wrapping region along an axis direction;
- a first electrode, a second electrode, third electrode and a fourth electrode on a first terminal location and a second terminal location along the axis direction;
- a first coil wrapped in the first wrapping region and comprising:
  - a first winding leg having a first end connected to the first electrode and a second end extending towards the second wrapping region; and
  - a second winding leg having a first end connected to the first winding leg and a second end connected to the second electrode;
- a second coil wrapped in the second wrapping region comprising:
  - a third winding leg having a first end connected to the third electrode and a second end extending towards the first wrapping region; and
  - a fourth winding leg having a first end connected to the third winding leg and a second end connected to the fourth electrode;

wherein:
- the first terminal location and the second terminal location are on opposite sides of the axis direction;
- the first wrapping region is between the first terminal location and the second wrapping region;
- the second wrapping region is between the second terminal location and the first wrapping region;
- the first coil is not wrapped in the second wrapping region; and
- the second coil is not wrapped in the first wrapping region.

2. The apparatus of coupled inductors of claim 1, wherein the material body disposed along the axis direction, the material body including a first core provided for the first wrapping region, a second core provided for the second wrapping region, a first terminal part disposed on the first terminal location, and a second terminal part disposed on the second terminal location, wherein:
- the first core is connected to the first terminal part;
- the second core is an extension of the first core and is connected to the second terminal part;
- the first electrode and the second electrode are connected to the first terminal part; and
- the third electrode and the fourth electrode are connected to the second terminal part.

3. The apparatus of coupled inductors of claim 1, further a compensation capacitor coupled between the first coil and the second coil.

4. The apparatus of coupled inductors of claim 3, wherein the compensation capacitor is coupled between the first electrode and the third electrode to compensate an inter-coil capacitance of a parasitic capacitor formed between the second electrode and the fourth electrode, and a capacitance of the compensation capacitor is between 90% and 110% of the inter-coil capacitance.

5. The apparatus of coupled inductors of claim 4, wherein the capacitance of the compensation capacitor is equal to the inter-coil capacitance.

6. The apparatus of coupled inductors of claim 1, wherein:
- the first winding leg includes M1 windings;
- the second winding leg includes N1 windings;
- the third winding leg includes M2 windings;
- the fourth winding leg includes N2 windings;
- $|M1-M2|/M1$ is smaller than 0.25;
- $|N1-N2|/N1$ is smaller than 0.25;
- M1, M2, N1 and N2 are positive numbers;
- M1 is larger than or equal to M2; and
- N1 is larger than or equal to N2.

7. The apparatus of coupled inductors of claim 6, wherein M1=M2 and N1=N2.

8. The apparatus of coupled inductors of claim 1, wherein the first winding leg is overlapped with the second winding leg, and the third winding leg is overlapped with the fourth winding leg.

9. The apparatus of coupled inductors of claim 1, wherein the first coil and the second coil are symmetrically disposed, and a portion of the first coil and a portion of the second coil closest to one another are symmetrically disposed to form an inter-coil capacitance so that electromotive forces induced by a first inductance of the first coil and a second inductance of the second coil at the portion of the first coil and the portion of the second coil closest to one another are kept substantially equal in amplitude.

10. The apparatus of coupled inductors of claim 1, wherein the first coil is wrapped along the axis direction in a clockwise manner and the second coil is wrapped along the axis direction in a counter-clockwise manner.

11. The apparatus of coupled inductors of claim 1, wherein the first electrode, the second electrode, the third electrode, and the fourth electrode are disposed on four corners of a quadrilateral; and a line between the second electrode and the third electrode corresponds to a diagonal of the quadrilateral.

12. The apparatus of coupled inductors of claim 1, wherein:

the first electrode and the fourth electrode are coupled to a positive terminal of a power sourcing equipment (PSE) in a Power over Ethernet (PoE) system or coupled to a positive terminal of a powered device (PD) in the PoE system;

the second electrode is coupled to a positive terminal of at least one data-carrying wire pair in the PoE system; and the third electrode is coupled to a negative terminal of the at least one data-carrying wire pair.

13. The apparatus of coupled inductors of claim 1, wherein:

the second electrode and the third electrode are coupled to a positive terminal of a PSE in a PoE or coupled to a positive terminal of a PD in the PoE system;

the first electrode is coupled to a positive terminal of at least one data-carrying wire pair in the PoE system; and the fourth electrode is coupled to a negative terminal of the at least one data-carrying wire pair.

14. The apparatus of coupled inductors of claim 1, wherein:

the first electrode is coupled to a positive terminal of a power sourcing equipment (PSE) in a Power over Ethernet (PoE) system or coupled to a positive terminal of a powered device (PD) in the PoE system;

the second electrode is coupled to a negative terminal of at least one data-carrying wire pair in the PoE system;

the third electrode is coupled to a negative terminal of the PSE or a negative terminal of the PD; and the fourth electrode is coupled to a positive terminal of the at least one data-carrying wire pair.

15. The apparatus of coupled inductors of claim 1, wherein:

the first electrode and the second electrode are disposed on the first terminal location; and the third electrode and the fourth electrode are disposed on the second terminal location.

* * * * *